United States Patent [19]

Tsuchihashi et al.

[11] Patent Number: 4,481,446

[45] Date of Patent: Nov. 6, 1984

[54] METAL VAPOR DISCHARGE LAMP

[75] Inventors: Michihiro Tsuchihashi; Katsuya Otani; Ryo Suzuki, all of Kamakura, Japan

[73] Assignee: Mitsubishi Denki Kabushiki Kaisha, Tokyo, Japan

[21] Appl. No.: 407,697

[22] Filed: Aug. 12, 1982

Related U.S. Application Data

[63] Continuation of Ser. No. 141,402, Apr. 18, 1980.

[51] Int. Cl.[3] ..... H01J 7/44; H01J 17/34; H01J 19/78; H01J 23/16

[52] U.S. Cl. ..... 315/73; 313/25; 313/568; 315/46; 315/47; 315/49; 315/74; 315/100

[58] Field of Search ..... 315/73, 74, 47, 49, 315/100, 104, 46; 313/25, 568, 570, 572

[56] References Cited

U.S. PATENT DOCUMENTS

| | | | |
|---|---|---|---|
| 2,116,741 | 5/1938 | Elenbaas | 313/25 |
| 2,749,462 | 6/1956 | Kenty et al. | 313/25 |
| 3,610,983 | 10/1971 | Grabner et al. | 313/25 |
| 3,619,682 | 11/1971 | Waymouth | 315/47 |
| 3,662,203 | 5/1972 | Kuhl et al. . | |
| 3,746,914 | 7/1973 | Olson et al. | 315/47 |
| 3,753,018 | 8/1973 | Beijer et al. | 315/73 |
| 3,895,248 | 7/1975 | de Vrijer | 313/25 |
| 4,135,114 | 1/1979 | Narikiyo | 315/75 |
| 4,137,483 | 1/1979 | Ochi et al. | 315/84 |
| 4,170,744 | 10/1979 | Hansler | 315/74 |
| 4,316,122 | 2/1982 | Yamazaki et al. | 315/74 |
| 4,344,018 | 8/1982 | Inada | 315/73 |

FOREIGN PATENT DOCUMENTS

| | | | |
|---|---|---|---|
| 1467050 | 12/1966 | France | 315/73 |
| 57249 | 5/1981 | Japan | 315/47 |

*Primary Examiner*—Saxfield Chatmon
*Attorney, Agent, or Firm*—Oblon, Fisher, Spivak, McClelland & Maier

[57] ABSTRACT

In a metal vapor discharge lamp for operating it by high voltage generated in the actuation of a heat sensitive switch means in an outer bulb, a relatively low pressure of a sealed gas or mercury is sealed in the outer bulb to operate the heat sensitive switch means in the gas atmosphere to control the surge voltage to a desired degree whereby the discharge lamp is operated without failure and the insulation breakdown of a ballast and an operation circuit is prevented.

10 Claims, 4 Drawing Figures

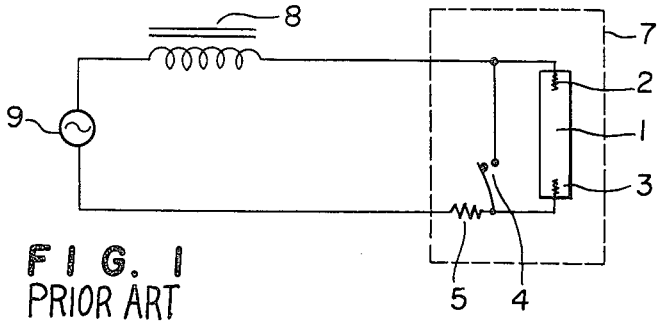
FIG. 1
PRIOR ART
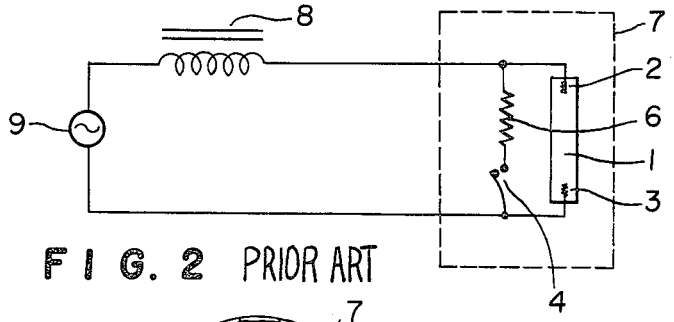
FIG. 2 PRIOR ART
FIG. 3
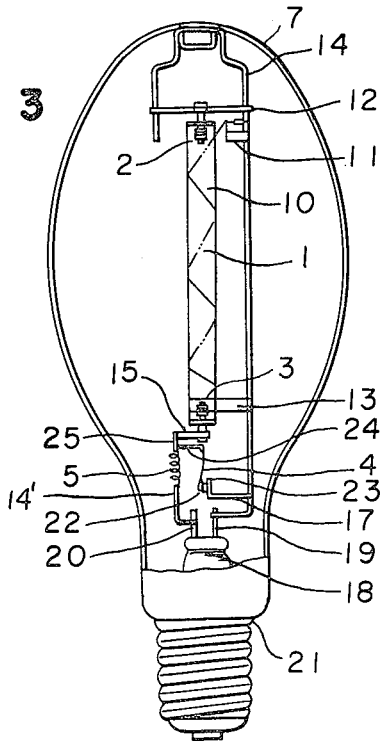

METAL VAPOR DISCHARGE LAMP

This is a continuation of application Ser. No. 141,402, filed Apr. 18, 1980.

BACKGROUND OF THE INVENTION

1. Field of the Invention

The present invention relates to a metal vapor discharge lamp which is operated by applying high voltage generated in an actuation of a heat sensitive switch means.

2. Description of the Prior Arts

Recently, a high pressure sodium vapor discharge lamp and a metal halide discharge lamp have been remarkably developed to replace the conventional high pressure mercury vapor discharge lamp. The energy saving of such discharge lamps has been highly evaluated. Thus, such discharge lamps have higher starting voltage than that of the high pressure mercury vapor discharge lamp and can not be operated by a ballast for the high pressure mercury vapor discharge lamp and has been operated by a special ballast which is equipped with a starter for generating high voltage pulse such as several thousands volts. Such special ballast has larger size, heavier weight and higher cost than those of the ballast for the high pressure mercury vapor discharge lamp. These disadvantages are trouble for higher commercial expansion of the high pressure sodium vapor discharge lamp or the metal halide discharge lamp.

In order to prevent such troubles and to attain the rapid commercial expansion of such discharge lamps, various improvements have been proposed.

Among these proposals, the optional proposal in the practical application, is to operate the metal vapor discharge lamp such as the high pressure sodium vapor lamp and the metal halide lamp by using the conventional ballast for the high pressure mercury vapor discharge lamp. In order to operate the metal vapor discharge lamp, it requires a pulse voltage having several thousands volts for the initiation. In order to generate such pulse voltage, the circuits shown in FIGS. 1 and 2 have been used. In the conventional method, the heat sensitive switch means (4) such as a bimetallic switch is placed in an outer bulb (7) of the discharge lamp. The lamp is operated by utilizing the high pulse voltage (surge voltage) generated in the ballast (8) at a moment detaching the contact point by the operation of the heat sensitive switch means (4). It is possible to operate the metal vapor discharge lamp by a compact, light weight, economical ballast for the high pressure mercury vapor discharge lamp by connecting the heat sensitive switch means (4) in the outer bulb (7) without placing a starter in the ballast (8). However, in the conventional method placing the heat sensitive switch means (4) in the outer bulb (7), it is possible to operate the metal vapor discharge lamp such as the high pressure sodium vapor discharge lamp by the ballast for the high pressure mercury vapor discharge lamp. When the arc tube (1) is in the normal condition, the discharge lamp can be operated without failure by surge voltage given by operation of the heat sensitive switch means (4). There is no trouble in the practical application. When the arc tube (1) is not operated in the normal condition, or is not easily initiated, or it is in the last term of the life, the surge voltage at the operation of the heat sensitive switch means is 10 to 20 [KV], whereby the insulation breakdown of the ballast (8) and the operating circuit may be caused. The breakdown of parts of the ballast or the operating circuit is frequently caused to be inoperative.

In order to decrease the surge voltage and to decrease the insulation breakdown, it has been proposed to have the structure shown in FIG. 2 wherein the current limit resistor (6) is connected in series to the heat sensitive switch means (4) so as to decrease the current passing through the contact point of the heat sensitive switch means (4). In such method, the surge voltage of about 10 [KV] is generated in the operation of the heat sensitive switch means in the abnormal condition of the arc tube (1), whereby the insulation breakdown of the ballast and the operating circuit may be caused.

SUMMARY OF THE INVENTION

The present invention is to overcome the disadvantages.

A feature of the present invention is to operate a metal vapor discharge lamp without failure and to prevent an insulation breakdown of a ballast and an operating circuit by controlling a surge voltage at a desired degree by sealing a sealed gas in an outer bulb under a pressure of less than 100 [Torr] in the metal vapor discharge lamp equipped with an arc tube and a heat sensitive switch means in the outer bulb.

Another feature of the present invention is to operate the metal vapor discharge lamp without failure and to prevent an insulation breakdown of the ballast and the operating circuit by controlling a surge voltage at a desired degree by actuating the heat sensitive switch means in a sealed gas containing mercury in the outer bulb of the metal vapor discharge lamp.

The other feature of the present invention is to operate the metal vapor discharge lamp without failure and to prevent an insulation breakdown of the ballast and the operating circuit by controlling the surge voltage in a range of 1,000 to 5,000 [V] by actuating the heat sensitive switch means in a sealed gas under the pressure of greater than $10^{-4}$ [Torr] in the outer bulb of the metal vapor discharge lamp.

The other feature of the present invention is to operate the metal vapor discharge lamp without failure and to prevent an insulation breakdown of the ballast and the operating circuit by controlling the surge voltage in a desired degree by actuating the heat sensitive switch means in a sealed gas under the pressure of from $10^{-4}$ to 10 [Torr] in a metal halide discharge lamp equipped with at least the arc tube and the heat sensitive switch means in the outer bulb.

BRIEF DESCRIPTION OF THE DRAWINGS

FIGS. 1 and 2 are respectively circuit diagrams of the metal vapor discharge lamp equipped with an arc tube and a heat sensitive switch means in an outer bulb;

FIG. 3 is a sectional view of one embodiment of a high pressure sodium vapor discharge lamp according to the present invention.

DETAILED DESCRIPTION OF THE PREFERRED EMBODIMENTS

Figure 4:
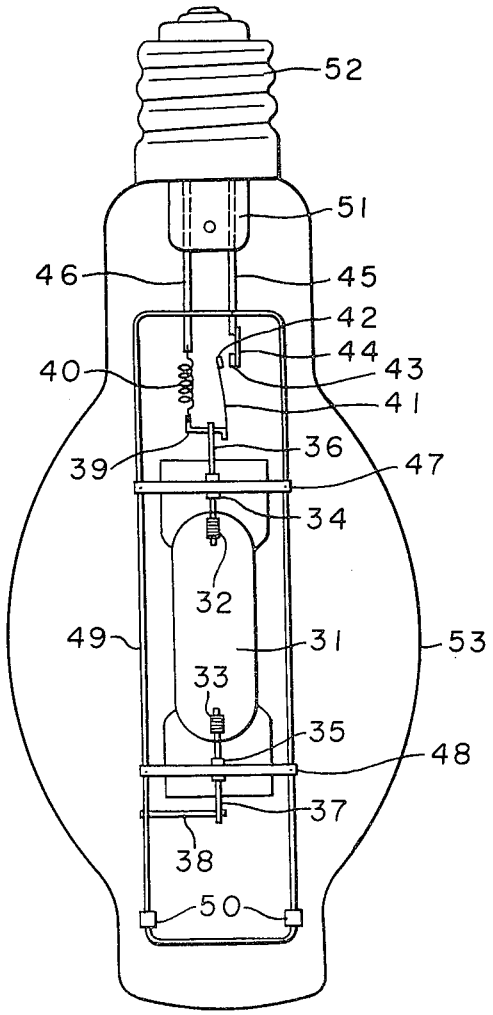
FIG. 4 is a sectional view of one embodiment of a metal halide discharge lamp according to the present invention.

FIG. 3 shows the high pressure sodium vapor discharge lamp according to the present invention. The arc tube (1) of the high pressure sodium vapor discharge lamp made of a polycrystalline alumina at both ends of which electrodes (2), (3) are sealed to face each other and in which a desired amount of Na-Hg amalgam and xenon at about 300 [Torr] are sealed, is fixed on a support frame (14) by support plates (12), (13). The electrode (2) is connected through the conductive support plate (12) as a lead wire to the support frame (14). The electrode (3) is connected through a lead wire (15), (25), a filament (5) for heating a bimetal; the support frame (14') and a stem lead (20) to one terminal of a base (21). The conductive support frame (14) is connected through a stem lead (19) to the other terminal of the base (21). The stem leads (19), (20) are respectively fixed by fuse-bonding under the electrical insulation on the stem (18) fused at one end of the outer bulb (7). The lead (25) is connected through the lead (24), the bimetallic switch (4), the contact point (22),(23) and the lead (17) to the support frame (14). An auxiliary lead as a starting aid (10) is wound around the outer wall of the arc tube (1). One end of the operation auxiliary lead (10) is connected through the bimetallic switch (11) to the support frame (14).

In the conventional structure, the outer bulb (7) is evacuated at high vacuum degree so as to maintain high vacuum of about $10^{-7}$ [Torr] during the life time by a getter equipped in the outer bulb. In accordance with the above-mentioned structure, if the arc tube does not operate in the normal condition, the surge voltage having an order of about 10 [KV] is generated to cause the damage of the ballast etc.

The inventors have studied to prevent the generation of high surge voltage and to protect the ballast from the damage caused by the insulation breakdown by a practically effective manner. As a result, the inventors have found that it is effective to seal a relatively low pressure gas or mercury instead of maintaining high vacuum in the outer bulb.

When a rare gas such as xenon or mercury is sealed under a pressure of less than 100 [Torr] in the outer bulb of the high pressure sodium vapor discharge lamp shown in FIG. 3, the filament (5) for heating the bimetallic switch is heated by the current and the bimetallic switch (4) is heated and actuated by the radiation heat of the heated filament. When the contact between the contact points (22), (23) is detached, the surge voltage generated in the ballast is decreased to prevent the damage caused by the insulation breakdown of the ballast etc.

When the high pressure sodium vapor discharge lamp shown in FIG. 3 is connected through the ballast to the power source, the current passes through the closed circuit of ballast (not shown)-base (21)-stem lead (20)-part of support frame(14')-filament (5) for heating bimetal-leads(25),(24)-bimetallic switch (4)-contact points (22),(23)-lead (17)-support (14)-stem (19)-lead (19)-base (21)-ballast. The bimetallic switch (4) is heated by the radiation heat of the filament (5) heated by the current, whereby the bimetal switch (4) is actuated to detach the contact points (22), (23). The discharge is initiated between the electrodes (2), (3) by the surge voltage generated in the ballast to turn on the discharge lamp.

In this embodiment of the present invention, the inert gas or mercury is sealed in the outer bulb (7) and accordingly, a part of the energy of the surge voltage generated by the actuation of the bimetallic switch is consumed by the discharge between the contact points (22), (23) when the contact points (22), (23) are detached and the surge voltage is lower than that of the discharge lamp maintaining high vacuum in the outer bulb (7) to prevent needless high voltage. When the discharge between the electrodes (2), (3) is initiated by the desired surge voltage, the current passes through the closed circuit of ballast-base (21)-stem lead (20)-support frame (14 filament (5) for heating bimetallic switch-lead (25),(15)-electrodes (3), (2)-conductive support plate (12)-support frame (14)-stem lead (19)-base (21)-ballast. The starting aid (10) placed around the arc tube (1) through the bimetallic switch (11) contributes only when the initiation of the discharge of the lamp. In the stable operation of the discharge lamp, the contact of the bimetallic switch (11) is kept in OFF state and the starting aid (10) is electrically disconnected. In the stable operation, the bimetal (4) is also heated by the filament (5) whereby the contact points (22), (23) are kept in OFF state.

The pressure of the sealed gas in the outer bulb (7) should be less than 100 [Torr]. When the pressure is greater than 100 [Torr], the consumption of the energy of the surge voltage is increased by the discharge between the contact points (22), (23) to remarkably decrease the surge voltage in the actuation of the bimetallic switch (4) whereby the discharge lamp is not initiated.

In the above-mentioned embodiment, xenon is used as the sealed gas in the outer bulb (7). The sealed gas can be krypton or argon to attain the same effect. It is also possible to use helium, neon, nitrogen or a mixture thereof. It is possible to mix a small amount of hydrogen, carbon monoxide or carbon dioxide gas. The purpose of the present invention is attained under the pressure of the sealed gas of less than 100 [Torr] at the ambient temperature. The optimum pressure of the sealed gas is in a range of 20 to $10^{-4}$ [Torr]. The amount of mercury sealed in the outer bulb (7) is enough to give the saturated vapor pressure at the ambient temperature. It is also possible to seal one or more gas of xenon, krypton, argon helium, neon or nitrogen and it is also possible to mix a small amount of hydrogen, carbon monoxide, or carbon dioxide.

The purpose of the present invention is attained under the pressure of the sealed gas of less than 20 [Torr]. The optimum pressure of the sealed gas is in a range of 20 to $10^{-4}$ [Torr]. When the pressure is greater than 20 [Torr], the consumption of the energy of the surge voltage is increased by the discharge between the contact points (22), (23) in the actuation of the bimetallic switch (4) and the surge voltage is remarkably decreased and the discharge lamp is not initiated.

As the factor for overcoming the disadvantages of the conventional one, the surge voltage generated by actuating the heat sensitive switch means is higher than the starting voltage and lower than the insulation breakdown voltage.

Thus, in the method of controlling the surge voltage by connecting a current limiting resistor in series to the contact of the heat sensitive switch means, the average surge voltage can be controlled, but the fluctuation of the surge voltage is large. When the resistance of the current limiting resistor is controlled so as to generate the surge voltage for initiating the arc tube requiring a voltage of greater than 1,000 volt at the initiation, the insulation breakdown of the ballast etc. is caused by the high voltage caused by the fluctuation of the surge voltage.

The inventors have studied to control the average voltage and the fluctuation of the surge voltage and to find the limitation of the surge voltage preventing the insulation breakdown of the ballast. As a result, it is found that the insulation breakdown is not caused at a peak value of less than 5,000 [V] and is preferably less than 4,000 [V]. The method of controlling the fluctuation of the surge voltage has been further studied. As a result, it is found that a sealing of the gas in the outer bulb under relatively low pressure is effective.

In the embodiment of the present invention, xenon is sealed in the outer bulb under the pressure of 0.01 to 0.1 [Torr]. Therefore, the arc tube requiring high voltage of higher than 1,000 V (about 3,000 V in this embodiment) can be operated without failure. Moreover, even though the arc tube is out of the normal operation, the surge voltage is not higher than 5,000 [V]. The reason is considered as a phenomenon that the discharge is initiated through the sealed gas in the outer bulb when a voltage higher than a certain value is generated, and the breakdown voltage in the outer bulb is kept below a predetermined value caused by the consumption of the energy of the higher voltage of the surge.

The pressure of the sealed gas in the outer bulb should be greater than $10^{-4}$ [Torr]. When the pressure is less than $10^{-4}$ [Torr], the fluctuation is remarkably large and a desired result is not attained.

In this embodiment, xenon is used as the sealed gas, it is also possible to operate the discharge lamp without failure by using krypton, argon or nitrogen. Moreover, the same effect is attained by sealing the sealed gas under the optimum pressure so as to prevent the increase of the surge voltage over 5,000 [V], even though the arc tube is not in the normal condition. It is also possible to use helium or neon, or a mixture thereof. The other gas may be used to attain the similar effect.

In the aove-mentioned embodiment, the high pressure sodium vapor discharge lamp have been described. The same effect can be expected by applying this embodiment to the other metal vapor discharge lamp operated by the heat sensitive switch means such as the metal halide discharge lamp and the mercury vapor discharge lamp.

The discharge lamp is not limited to have the circuit shown in FIG. 1 or 2, and a discharge lamp comprising an arc tube and a heat sensitive switch means for operation and other desired element can be used in the present invention.

FIG. 4 shows the metal halide discharge lamp according to the present invention. The arc tube (31) made of quartz at both ends of which electrodes (32), (33) are sealed to face each other and in which a desired amount of a metal halide and argon at about 20 [Torr] are sealed, is fixed on a support frame (49) by support plates (47), (48). The electrode (32) is connected through a molybdenum foil (34), an electrode lead (36), a lead (39) and a filament (40) to a stem lead (46). The stem lead (46) is connected to one of the terminal of a base (52). The lead (39) connected to the electrode lead (36) is connected through a bimetallic switch (41), contact points (42), (43), a lead (44) and a stem lead (45) to the other terminal of the base (52). A conductive support frame (49) is connected to the stem lead (45). The stem leads (45), (46) are electrically insulated and fixed on a stem (51) fused at one end of an outer bulb (53). The electrode (33) is connected through the molybdenum foil (35), the electrode lead (37) and the lead (38) to the support frame (49).

In the conventional structure, the outer bulb (53) is evacuated at high vacuum so as to maintain high vacuum of about $10^{-7}$ [Torr] during the life time by a getter equipped in the outer bulb. In accordance with the above-mentioned structure, if the arc tube does not operate in the normal condition, the surge voltage having an order of about 10 [KV] is generated to cause the damage of the ballast etc.

The inventors have studied to prevent the generation of high surge voltage and to protect the ballast from the damage caused by the insulation breakdown by a practically effective manner. As a result, the inventors have found that it is effective to seal a relatively low pressure gas instead of maintaining high vacuum in the outer bulb.

When a rare gas such as xenon is sealed under a pressure of from $10^{-4}$ to 10 [Torr] in the outer bulb (53) of the metal halide discharge lamp shown in FIG. 4, the filament (40) for heating the bimetallic switch is heated by the current and the bimetallic switch (41) is heated and actuated by the radiation heat of the heated filament. When contact between the contact points (42), (43) is detached, the surge voltage generated in the ballast is decreased to prevent the damage caused by the insulation breakdown of the ballast etc.

When the metal halide discharge lamp shown in FIG. 4 is connected through the ballast to the power source, the current passes through the closed circuit of ballast (not shown)-base (52)-stem lead (46)-filament (40) for heating bimetal-lead (39)-bimetallic switch (41)-contact points (42), (43)-lead (44)-stem lead (45)-base (52)-ballast. The bimetallic switch (41) is heated by the radiation heat of the filament (40) heated by the current, whereby the bimetallic switch (41) is actuated to detach the contact points (42), (43). The discharge is initiated between the electrodes (32), (33) by the surge voltage generated in the ballast to turn on the discharge lamp.

In this embodiment of the present invention, the rare gas is sealed in the outer bulb (53) and accordingly, a part of the energy of the surge voltage generated by the actuation of the bimetallic switch (41) is consumed by the discharge between the contact points (42), (43) when the contact points (42), (43) are detached and the surge voltage is lower than that of the discharge lamp maintaining high vacuum in the outer bulb (33) to prevent needless high voltage. When the discharge between the electrodes (32), (33) is initiated by a desired surge voltage, the current passes through the closed circuit of ballast-base (52)-stem lead (46)-filament (40) for heating bimetal-lead (39)-electrode lead (36)-molybdenum foil (34)-electrodes (32), (33)-molybdenum foil (35)-electrode lead (37)-lead (38)-support frame (49)-stem lead (45)-base (52)-ballast.

In the stable operation of the discharge lamp, the bimetallic switch (41) is heated by the filament (40) to maintain the detaching of the contact points (42), (43).

The pressure of the sealed gas in the outer bulb (53) should be controlled in a range of $10^{-4}$ to 10 [Torr]. When the pressure is greater than 10 [Torr], the consumption of the energy of the surge voltage is increased by the discharge between the contact points (42), (43) to remarkably decrease the surge voltage in the actuation of the bimetallic switch (41), whereby the discharge lamp is not initiated. When the pressure is less than $10^{-4}$ [Torr], the effect for decreasing the surge voltage is not satisfactory to cause the damage by the insulation breakdown of the ballast.

In the above-mentioned embodiment, xenon is used as the sealed gas in the outer bulb (53). The sealed gas can be krypton or argon to attain the same effect. It is also possible to use helium, neon, nitrogen or a mixture thereof.

The purpose of the present invention is attained under the pressure of the sealed gas of from $10^{-4}$ to 10 [Torr]. The optimum pressure of the sealed gas is in a range of 1 to $10^{-3}$ [Torr].

We claim:

1. A metal vapor discharge lamp which comprises:
(a) an outer bulb;
(b) electric circuit means disposed in said outer bulb, said electric circuit means including;
(i) an arc tube;
(ii) a first heat-sensitive switch means connected in parallel with said arc tube;
(iii) heating means disposed adjacent said first heat-sensitive switch means, said heating means being connected in series with said first heat-sensitive switch means;
(iv) a starting aid disposed adjacent said arc tube and extending along the longitudinal direction of said arc tube; and
(v) a second heat-sensitive switch means connected in series with said starting aid; and
(c) a gas at a subatmospheric pressure within the range from $10^{-4}$ to 20 Torr sealed in said outer bulb, whereby:
(d) when electricity is initially supplied to said electric circuit means when the metal vapor discharge lamp is turned on:
(i) said heating means heats said first heat-sensitive switch means, causing said first heat-sensitive switch means to open and thereby causing a transitory voltage surge through said arc tube which initiates discharge of the lamp, and
(ii) said starting aid is energized, contributing to the initiation of the discharge of the lamp;
(e) after discharge of the lamp has begun:
(i) the heat generated by said arc tube heats said second heat-sensitive switch means, causing said second heat-sensitive switch means to open and thereby turning off said starting aid, and
(ii) the heat generated by said heating means and said arc tube insures that said first heat-sensitive switch means remains open during the discharge of the lamp; and
(f) the relatively low-vacuum gas present in said bulb moderates the transitory surge voltage which would be experienced by said arc tube if a conventional high vacuum were present in said outer bulb.

2. A metal vapor discharge lamp as recited in claim 1 wherein said gas is selected from the group consisting of xenon, krypton, argon, or mixtures thereof.

3. A metal vapor discharge lamp as recited in claim 1 wherein said gas is selected from the group consisting of helium, neon, nitrogen, or mixtures thereof.

4. A metal discharge lamp as recited in claim 1 wherein said gas is selected from the group consisting of hydrogen, carbon monoxide, carbon dioxide, or mixtures thereof.

5. A metal vapor discharge lamp as recited in claim 1 wherein said gas comprises mercury vapor.

6. A metal vapor discharge lamp as recited in claim 1 wherein the elements of said electric circuit means are selected so as to maintain the transient surge voltage within a range of 1,000 to 5,000 volts.

7. A metal vapor discharge lamp as recited in claim 1 wherein said second heat-sensitive switch means is physically spaced from said heating means so that, when electricity is initially supplied to said electric circuit means when the metal vapor discharge lamp is turned on, said heating means does not heat said second heat-sensitive switch means sufficiently to open it, whereby said second heat-sensitive switch means remains closed until after discharge of the lamp has begun.

8. A metal vapor discharge lamp as recited in claim 1 wherein said heating means is connected in series with said arc tube as well as with said first heat-sensitive switch means.

9. A metal vapor discharge lamp as recited in claim 8 wherein said starting aid is electrically connected in parallel with said arc tube.

10. A metal vapor discharge lamp as recited in claim 1 wherein said starting aid is electrically connected in parallel with said arc tube.

* * * * *

UNITED STATES PATENT AND TRADEMARK OFFICE

CERTIFICATE OF CORRECTION

PATENT NO. : 4,481,446

DATED : November 6, 1984

INVENTOR(S) : Tsuchihashi et al.

It is certified that error appears in the above-identified patent and that said Letters Patent is hereby corrected as shown below: On the title page:

The Priority Information has been omitted, should read as follows;

- -[30] FOREIGN/PCT APPLICATIONS-

| | | |
|---|---|---|
| JAPAN | 51739/1979 | 04/26/79 |
| JAPAN | 51740/1979 | 04/26/79 |
| JAPAN | 66539/1979 | 05/29/79 |
| JAPAN | 140093/1979 | 10/30/79 |
| JAPAN | 140882/1979 | 10/31/79 - - |

Signed and Sealed this

*Second* Day of *April 1985*

[SEAL]

*Attest:*

DONALD J. QUIGG

*Attesting Officer* *Acting Commissioner of Patents and Trademarks*